US006374764B1

(12) United States Patent
Davenport, III et al.

(10) Patent No.: US 6,374,764 B1
(45) Date of Patent: Apr. 23, 2002

(54) DECK INSTALLATION SYSTEM FOR OFFSHORE STRUCTURES

(75) Inventors: George F. Davenport, III, Cypress; Karl H. Runge, Houston; J. Don Murff, Austin, all of TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/409,044

(22) Filed: Sep. 29, 1999

Related U.S. Application Data

(60) Provisional application No. 60/107,316, filed on Nov. 6, 1998.

(51) Int. Cl.[7] ..... B63B 35/44

(52) U.S. Cl. ..... 114/265; 114/266; 405/200; 405/203

(58) Field of Search ..... 114/265, 266; 405/203, 200

(56) References Cited

U.S. PATENT DOCUMENTS

| | | | | | |
|---|---|---|---|---|---|
| 3,605,669 | A | * | 9/1971 | Yu | 114/265 |
| 3,986,471 | A | | 10/1976 | Haselton | 114/5 D |
| 4,117,691 | A | | 10/1978 | Spray | 405/205 |
| 4,576,520 | A | | 3/1986 | Suh et al. | 405/205 |
| 4,907,912 | A | * | 3/1990 | Smith | 405/200 |
| 5,088,858 | A | * | 2/1992 | Massoudi | 405/203 |
| 5,190,410 | A | | 3/1993 | Nunley | 405/196 |
| 5,447,391 | A | * | 9/1995 | Gallaher et al. | 405/203 |
| 5,551,801 | A | | 9/1996 | Gallaher et al. | 405/204 |
| 5,593,250 | A | * | 1/1997 | Smith et al. | 405/205 |
| 5,609,442 | A | | 3/1997 | Horton | 405/205 |

FOREIGN PATENT DOCUMENTS

| | | | |
|---|---|---|---|
| GB | 2 145 378 A | 3/1985 | B63B/1/12 |
| GB | 2 172 554 A | 9/1986 | B63B/1/12 |
| GB | 2 253 813 A | 9/1992 | B63B/35/44 |

* cited by examiner

*Primary Examiner*—Stephen Avila
(74) *Attorney, Agent, or Firm*—Kelly A. Morgan; Gary P. Katz

(57) ABSTRACT

An apparatus and method for installing a deck on an offshore substructure is provided. The apparatus comprises a deck supported by lifting mechanisms that are in turn attached to pontoons. The apparatus floats on the water with the lifting mechanisms compressed until transported to an offshore substructure having an upper end located above the water surface. The lifting mechanisms are then extended and the apparatus moved on the surface of the water to position the deck over the substructure. The deck is then lowered onto the substructure and the pontoons are lifted out of the water.

13 Claims, 5 Drawing Sheets

DECK INSTALLATION SYSTEM FOR OFFSHORE STRUCTURES

This application claims the benefit of U.S. Provisional Application No. 60/107,316 filed Nov. 6, 1998.

FIELD OF INVENTION

This invention relates generally to the field of offshore platforms used in hydrocarbon exploration and/or production. More particularly, the invention pertains to the erection of such platforms utilizing an integrated deck installation and transport system.

BACKGROUND OF THE INVENTION

Exploration and production of hydrocarbon reserves in arctic offshore regions present unique challenges. Starting in the late 1970's certain offshore hydrocarbon reservoirs in arctic regions were developed by installing exploration and production equipment on man-made islands. These islands were constructed of gravel, sand, or dredged seabed fill material and were used in relatively shallow waters (approximately 50 feet or less) close to the shore. After construction of such an island, drilling rigs and equipment were brought to the site either by helicopter, by trucking over the surrounding ice during early winter, or by barge during the warmer months. These systems were cost-effective where ease of access from land, suitable fill material, and stable ice conditions existed. Examples of these man-made islands are described generally in Galloway, Scher, and Prodanovic, "The Construction of Man-Made Drilling Islands and Sheetpile Enclosed Drillsites in the Alaskan Beaufort," 1982 Offshore Technology Conference (OTC) Paper No. 4335, and Agerton, "Construction of an Arctic Offshore Gravel Island in 39 ft of Water During Winter and Summer," 1983 OTC Paper No. 4548.

For operations in water depths of greater than 50 feet, island fill volumes, and therefore costs, become excessive due to the natural slopes of the fill material (e.g. 1:3 for gravel, 1:12 for sand/silt). To reduce island fill volumes, the Caisson Retained Island (CRI) was developed. Steel and concrete CRIs provide much steeper slopes than the natural fill material. Once installed at the site, either on the sea bottom or on a submerged berm, the caissons are filled with dredged material. These systems are described generally in Fitzpatrick and Denning, "Design and Construction of Tarsiut Island in the Canadian Beaufort Sea," 1983 OTC Paper No. 4517 and Mancini, Dowse, and Chevallier, "Caisson Retained Island for Canadian Beaufort SeaGeotechnical Design and Construction Considerations," 1983 OTC Paper No.4581. After construction of the CRI, drilling equipment is delivered to the working surface by either helicopter or barge.

As the desired water depth for exploration and production drilling continued to increase, man-made and caisson-retained islands became technically and economically infeasible. Due to the severe, dynamic ice loads in water depths greater than 60 feet and the relatively short open-water construction season, a number of new drilling concepts were developed in the early 1980's to suit the demanding environment. Examples of these new concepts include the Concrete Island Drilling System (CIDS), the Single Steel Drilling Caisson (SSDC), and the Mobile Arctic Caisson (MAC). These systems are described generally in: Gijzel, Thomson, and Athmer, "Installation of the Mobile Arctic Caisson Molikpaq," 1985 OTC Paper No. 4942; Masonheimer, Deily, and Knorr, "A review of CIDS First-Year Operations," 1986 OTC Paper No. 5288; and Masterson, Bruce, Sisodiya, and Maddock, "Beaufort Sea Exploration: Past and Future," 1991 OTC Paper No. 6530. These systems are generally large monolithic systems constructed and fully outfitted with drilling equipment in a temperate environment and then towed to the desired arctic location. Because of their large size, these systems are subject to comparably large ice and wave loads, resulting in increased design and construction cost to address those loads.

The CIDS, SSDC, and MAC systems have been successfully deployed for exploratory well drilling during the relatively short drilling season in the Canadian and Alaskan Beaufort Sea. However, these concepts may not be suitable for general year-round drilling without ice management and also are not truly mobile compared to conventional jack-up rigs, drill ships, and semi-submersibles. Use of these systems in greater water depths and/or more severe ice conditions (i.e. year-round operations) requires the construction of costly man-made berms in conjunction with expensive foundation and mooring systems. As a consequence, development of hydrocarbon reserves in certain arctic regions may be uneconomic using these systems due to the limited number of wells that can be drilled during the drilling season.

Conventional jack-up drilling rigs permit quick installation and removal of equipment at a drill site, but are structurally incapable of withstanding ice loads without significant strengthening thus severely limiting their usefulness in arctic regions. U. S. Pat. No. 4,648,751 (Coleman) discloses the use of a U-shaped barge for the delivery and installation of an integrated deck system to a single-column offshore substructure. The integrated deck is supported and transported on jack and leg assemblies mounted on the barge. Upon arrival at the substructure, the jacks are used to lift the integrated deck above the top of the substructure and the U-shaped barge is maneuvered to position the deck over the substructure. The jacks are then lowered to set the deck on the substructure and the barge is removed. Although the system disclosed in Coleman permits delivery of an integrated deck system to a single-column substructure capable of withstanding the arctic environment, installation or removal of the deck is dependent on the availability of a U-shaped barge of the correct configuration, size, and capacity.

Persons skilled in development of offshore hydrocarbon resources will readily understand the economic incentives for low-cost drilling platform systems. The use of integrated deck systems that are assembled remotely and then transported to the fmal offshore installation site may reduce overall erection costs regardless of temperature and weather conditions at the site. For certain arctic regions, this incentive is magnified if such a deck system can be used in combination with a small, single-column, ice-resistant substructure. Furthermore, it would be desirable to have a mobile drilling and production system capable of year-round drilling operations even in severe arctic conditions. Also, offshore platform systems capable of quick installation, removal, and relocation would be particularly advantageous in arctic regions subject to fast-changing and extreme weather and severe ice conditions. The present invention provides a system capable of meeting these needs.

SUMMARY OF THE INVENTION

The present invention includes an apparatus and a method for installation of a deck on to an offshore substructure. The apparatus can be configured either for floatation and transportation or for fixed hydrocarbon drilling operations. The invention is useful in any offshore environment but is particularly suited for economic development of offshore hydrocarbon reserves in severe arctic regions.

The apparatus is self-floating and includes a deck, at least one pontoon, and at least one lifting support connecting each pontoon to the deck. The one or more pontoons have sufficient composite buoyancy to provide the apparatus with a net positive buoyancy. In the floatation configuration, the deck is supported by the one or more lifting supports, which are in turn supported by the pontoon(s), and the entire weight of the apparatus rests on the water. The lifting supports are typically in a compressed position so that the deck is relatively close to the pontoons and the water, and the apparatus is sufficiently buoyant and stable for transport on the open water.

In the operation configuration, the entire weight of the apparatus is supported by the offshore substructure upon which the deck has been installed. The weight of the one or more pontoons is supported by the one or more lifting supports which are in turn supported by the deck. In the operation configuration, the lifting supports are typically in a compressed or retracted position so that the pontoons are free from contact by waves or ice. In some embodiments for improved seismic response, one or more of the pontoons are removed from the lifting supports after installation of the deck on the substructure. In other embodiments, the pontoon (s) provide floatation during transportation and serve as additional deck work area during operation. In yet other embodiments, the deck is configured to provide additional floatation during transportation.

Installation of the apparatus on to an offshore substructure having an upper end adapted to support the weight of the deck and the pontoons is accomplished by transporting the apparatus in the floatation configuration to a location proximate to the substructure. Preferably, the upper end of the substructure is also elevated above the surface of the water. The deck is then elevated an amount sufficient to permit positioning of the deck over the upper end of the substructure by extending the lifting supports. The apparatus is then moved on the surface of the water, with the lifting supports extended, to position the deck at a selected location over the upper end of the substructure. After positioning, the lifting supports are retracted until the weight of the apparatus is transferred from the water to the substructure. The lifting supports are further retracted to lift the pontoons to a desired elevation above the surface of the water.

BRIEF DESCRIPTION OF THE DRAWINGS

The present invention and its advantages will be better understood by referring to the following detailed description and the attached drawings as described below.

FIGS. 1A through 3 are directed toward a first embodiment of the invention having a catamaran arrangement of two pontoons.

FIGS. 1A, 1B, and 1C show front elevation, side elevation, and plan views, respectively, of the apparatus in the floatation configuration with the lifting supports in the compressed position.

FIG. 3 shows the front elevation of the deck installation system after the installation process is completed with the lifting supports in a compressed position.

FIGS. 4A through 6 are directed toward a second embodiment of the invention having a single U-shaped pontoon.

FIGS. 4A, 4B, and 4C show front elevation, side elevation, and plan views, respectively, of the apparatus in the floatation configuration with the lifting supports in the compressed position.

FIG. 6 shows the front elevation of the apparatus after the installation process is completed with the lifting supports in a compressed position.

FIGS. 7A through 9B are directed toward embodiments having lifting supports other than jack assemblies having fixed-length legs.

FIGS. 7A and 7B show front and side elevations of contracted and expanded hydraulic ram lifting supports.

FIGS. 9A and 9B show front and side elevations of contracted and expanded system of cables or chains and pulleys capable of raising or lowering a deck.

FIGS. 1A through 9B are not drawn to scale and are included only to illustrate the general arrangement of components for various embodiments of the invention. One skilled in the art would recognize that variations of dimensions and substitutions of particular components with other configurations that perform essentially the same function would be included within the scope of the invention. To the extent that the following detailed description is specific to a particular embodiment or a particular use of the invention, this is intended to be illustrative only, and is not to be construed as limiting the scope of the invention. On the contrary, it is intended to cover all alternatives, modifications, and equivalents which may be included within the spirit and scope of the invention, as defined by the appended claims.

DETAILED DESCRIPTION OF THE INVENTION

Figure 1C:
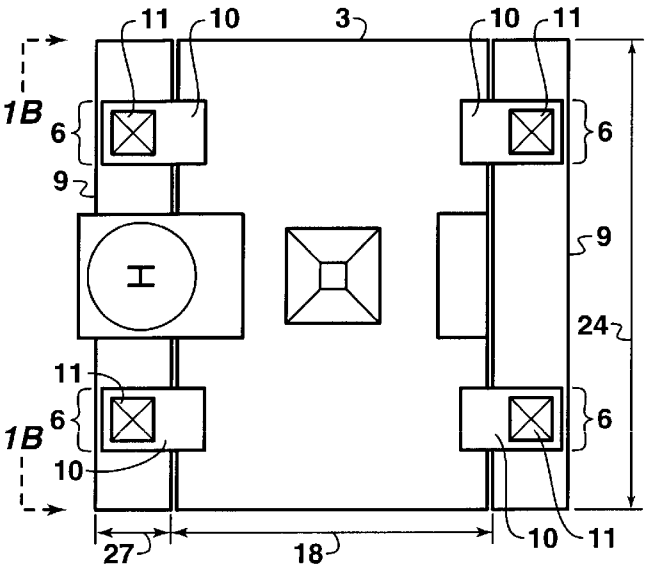
Figure 1A:
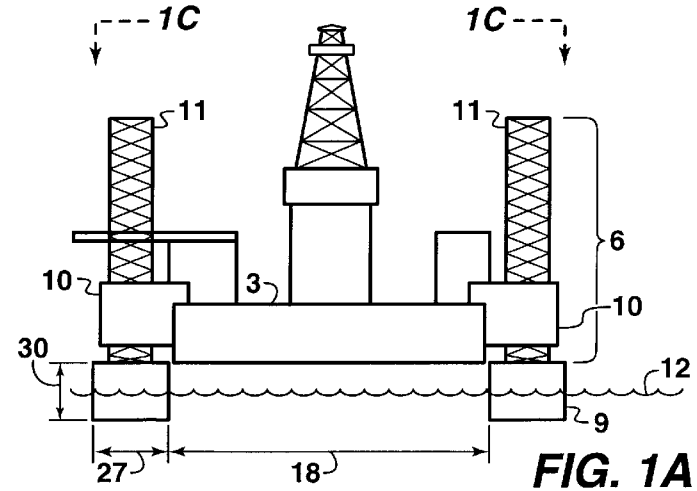
Figure 1B:
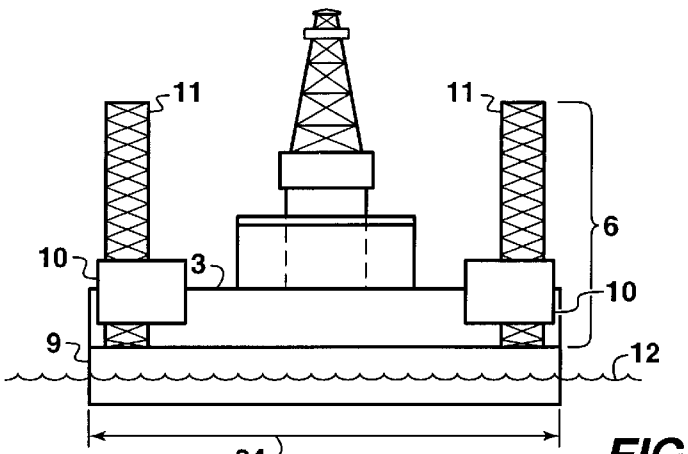

The integrated deck installation and transportation system of this invention, as illustrated in FIGS. 1A through 9B and described in the text below, is adapted for use in offshore hydrocarbon exploration and/or development. Although the embodiments shown in detail herein are particularly suited to installation in arctic environments, the invention is useful for offshore installations in any climate.

FIGS. 1A through 3 show a first embodiment of the invention in which two pontoons are positioned in a catamaran arrangement. FIGS. 4A through 6 show a second embodiment of the invention in which floatation is provided by a single U-shaped pontoon.

FIGS. 1A through 1C and 4A through 4C show the apparatus in the first and second embodiments, respectively, prior to installation on an offshore substructure or in the floatation configuration. A deck 3 is supported by lifting supports 6. As more fully described below, in this embodiment lifting supports 6 each comprise a jackhouse 10 and a support leg 11. The lifting supports 6 are in turn supported on pontoons 9. The pontoons 9 are designed to provide enough buoyant force to support the entire apparatus on the surface of the water 12. In the floatation configuration, the lifting supports are in a compressed or retracted position. The terms "compress" or "retract" and their variants as used in this specification and the appended claims indicates a reduction in the vertical distance between the deck 3 and the one or more pontoons 9. Conversely, the term "expand" means an increase in the vertical distance between the deck 3 and the pontoon(s) 9.

Figure 3:
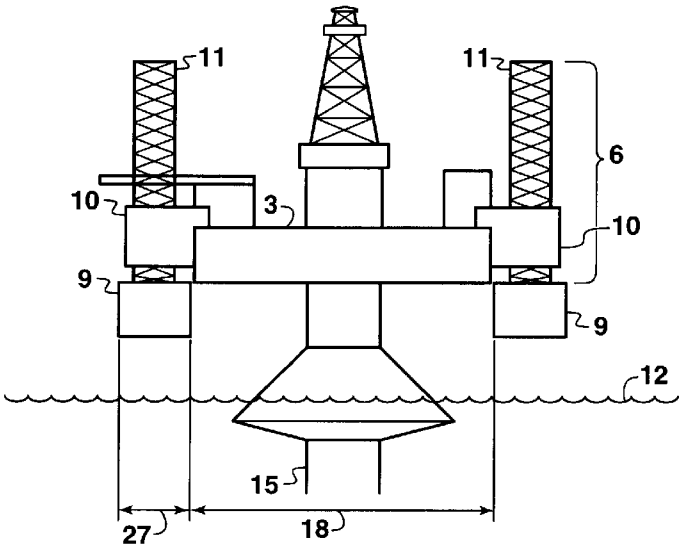
Figure 2B:
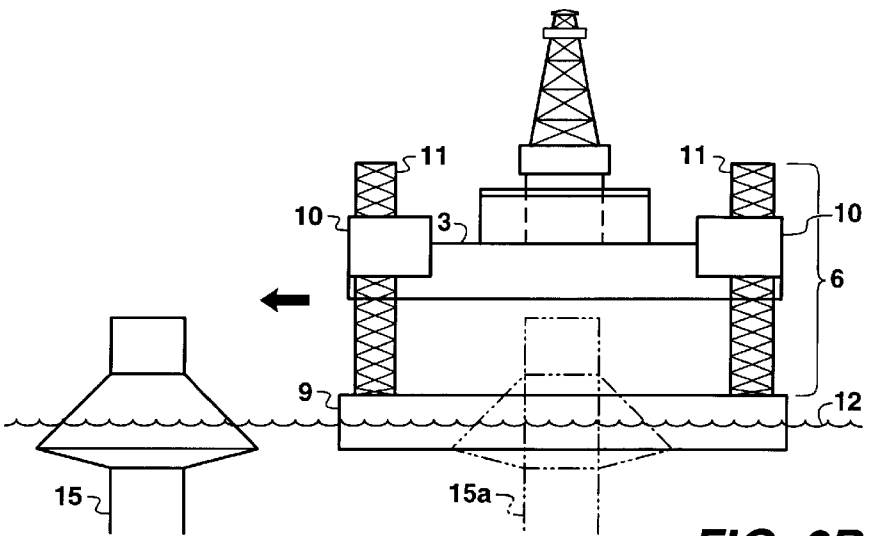
FIGS. 2A and 2B show front and side elevation views of the apparatus during the deck installation process with the lifting supports in the extended position.
Figure 2A:
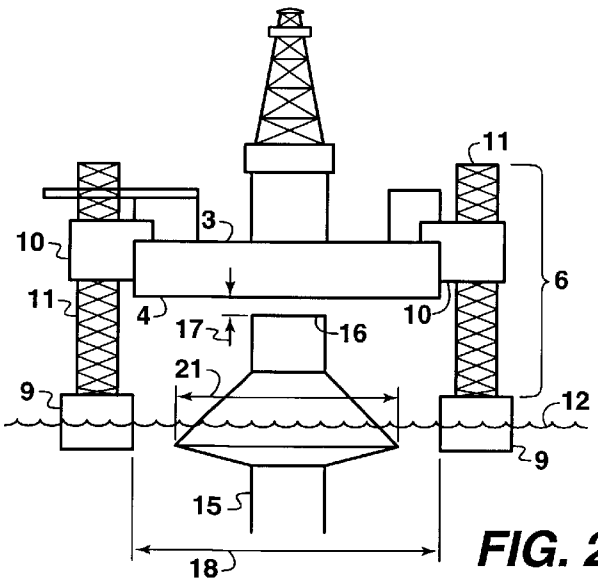
Figure 4C:
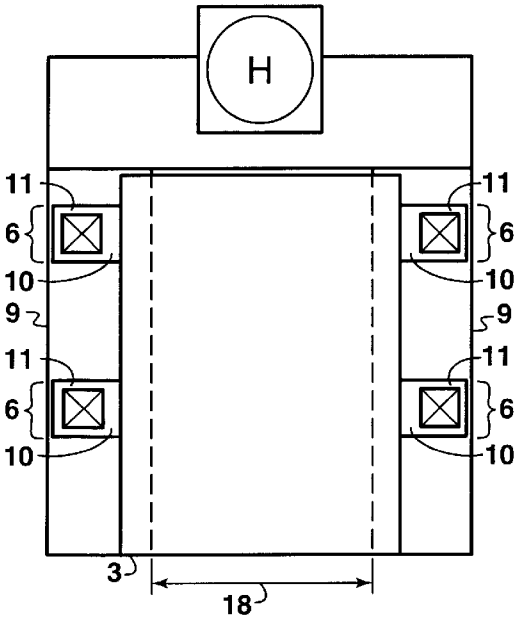
Figure 4A:
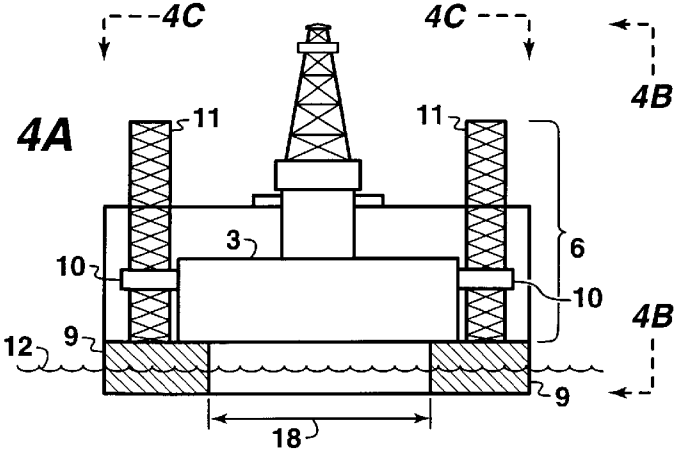
Figure 4B:
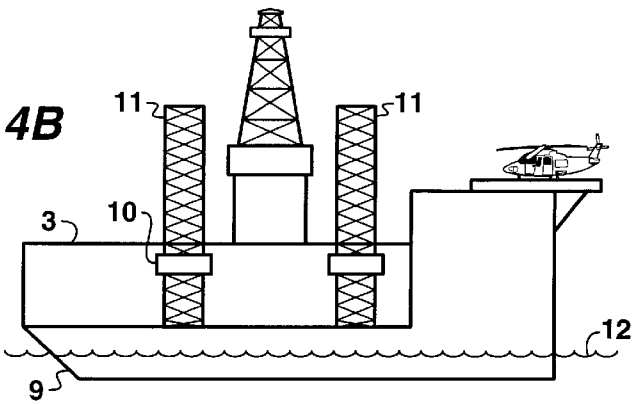
Figure 6:
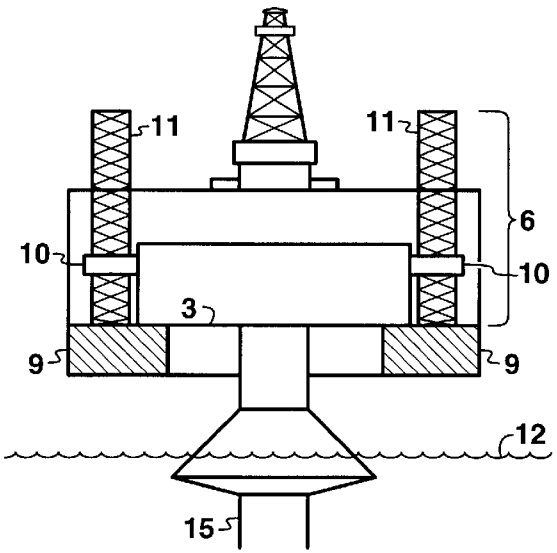
Figure 5B:
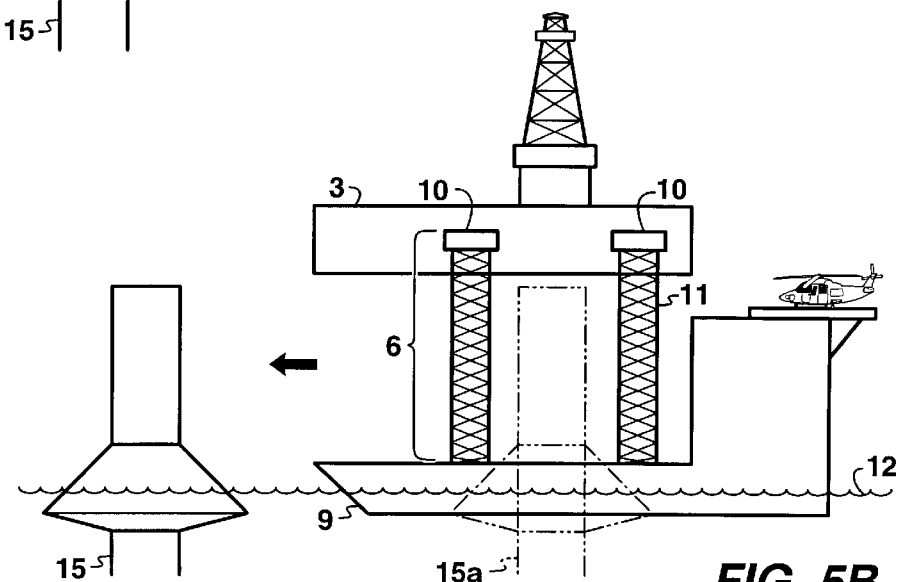
FIGS. 5A and 5B show front and side elevation views of the apparatus during the installation process with the lifting supports in the extended position.
Figure 5A:
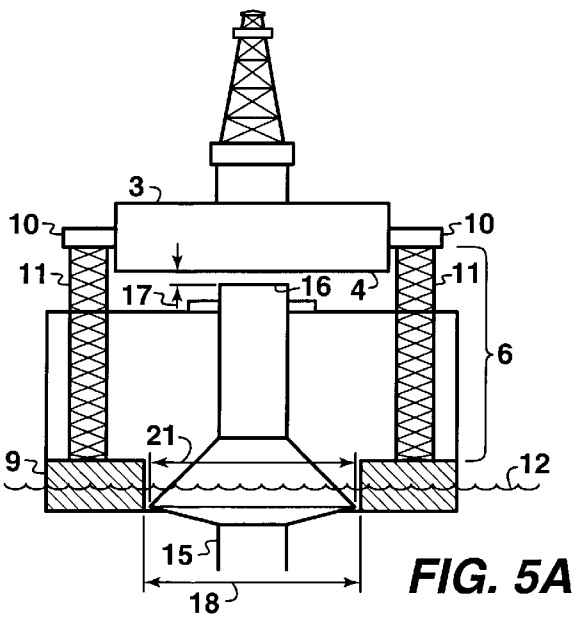

FIGS. 2A and 2B and 5A and 5B show the apparatus in the first and second embodiments, respectively, during the installation of the deck 3 on to an offshore substructure 15. The deck 3 is lifted from the floatation configuration to elevate the bottom 4 of the deck 3 above the upper end 16 of the offshore substructure 15. The apparatus is then moved on the surface of the water 12 to position the deck 3 over the substructure 15 as shown by the phantom rendition of substructure 15*a* in FIGS. 2B and 5B. After positioning of the deck 3 at a predetermined location over the substructure 15 as shown in FIGS. 2A and 2B and 5A and 5B, the lifting supports 6 are retracted to lower the deck 3 onto the substructure 15. Movement of the lifting supports 6 is continued until the bottom 4 of the deck 3 is in contact with the upper end 16 of the substructure 15. Movement of the lifting supports 6 is continued until the weight of the apparatus is transferred from the water 12 to the substructure 15 and pontoons 9 are lifted out of the water 12 as shown in FIGS. 3 and 6 for the first and second embodiments, respectively. In a preferred embodiment, the pontoons 9 are lifted to a sufficient height above the water surface 12 to eliminate exposure of the apparatus to loads induced by water conditions such as waves or ice.

The apparatus may be removed from the substructure 15 by expanding the lifting supports 6, thus lowering the pontoons 9, until the weight of the apparatus is transferred from the substructure 15 to the water 12 and the bottom 4 of the deck 3 is lifted above the upper end 16 of the substructure 15. The apparatus is then moved horizontally on the surface of the water 12 a distance sufficient to permit the deck 3 to be lowered to the floatation position without touching the substructure 15.

One skilled in the art would select the size, shape, and location of each pontoon or group of pontoons 9 to provide adequate buoyancy and stability for the apparatus both during transportation of the apparatus in the floatation configuration and during the process of installation on an offshore substructure 15. The layout of the pontoons 9 should permit movement of the apparatus on the surface of the water 12, with the lifting supports 6 extended, from a position where no portion of the deck 3 is over the substructure 15 to a position where the deck 3 can be set into place on the upper end 16 of the substructure 15 by retracting the lifting supports 6.

In the first and second embodiments as shown in FIGS. 1A through 6, this would mean that the pontoon clearance 18 must exceed the substructure waterline width 21. The pontoon clearance 18 is defined herein as the open horizontal distance on any side of the apparatus where there is no pontoon and no structure connecting pontoons. Pontoon clearance 18 on at least one side of the apparatus must be sufficient to permit moving an elevated deck 3 over the substructure 15 without the pontoon(s) 9 colliding with any portion of the substructure 15. This clear space must exist vertically from near the waterline up to the height of the upper end 16 of the substructure 15. This clear space must also extend under the elevated deck 3 a distance sufficient to permit positioning of the deck 3 over the upper end 16 of the substructure to facilitate transfer of the weight of the apparatus from the water 12 to the substructure 15. At least one pontoon clearance measurement 18 must exceed the substructure waterline width 21.

The substructure waterline width 21 is defined herein as the maximum width of the substructure 15 near the waterline when viewed from the direction of approach by the apparatus of this invention. "Near the waterline" will be understood to extend upward to the top of the pontoon 9 and downward to the bottom of the pontoon 9 when the pontoon is floating. Preferably, pontoon clearance 18 must exceed the substructure waterline width 21 by at least 2 meters, more preferably 4 meters, even more preferably 6 meters. In any event, the pontoon clearance 18 must be sufficient to permit movement of the apparatus on the water 12 and positioning of the deck 3 over the upper end 16 of the substructure 15 in order to facilitate transfer of the weight of the apparatus from the water 12 to the substructure 15. These dimensions may also be varied to address specific environmental conditions including but not limited to waves, currents, and wind.

The pontoons are arranged in the water in an open pattern. For purposes of this specification and the appended claims, an "open pattern" is defined as any plane figure or combination of plane figures, as circumscribed by the waterline of the one or more pontoons 9, having its centroid lying outside the perimeter of any of the figures in the pattern. An "open pattern" must also have at least one pontoon clearance 18 measurement that exceeds the substructure waterline width 21. Some embodiments of the apparatus have a single U-shaped pontoon or a U-shaped pattern of pontoons joined by structural steel and therefore have only one pontoon clearance measurement 18. U-shaped as used herein is an open pattern with a pontoon clearance 18 measurement on one side of the apparatus that exceeds the substructure waterline width 21. In a preferred embodiment, the outline of a single U-shaped pontoon 9 is formed by the single outline of three abutting rectangles. In another preferred embodiment, a U-shaped arrangement of pontoons is formed by three rectangular pontoons that are not abutting but are instead joined together by space-frame structures. Other embodiments have a catamaran arrangement of two parallel pontoons. A catamaran arrangement as used herein is an open pattern with a pontoon clearance 18 measurement on substantially opposite sides of the apparatus that exceed the substructure waterline width 21. Yet other embodiments have four pontoons with a pontoon clearance measurement 18 between each adjacent pair of pontoons.

One skilled in the art and given particular environmental design criteria would select pontoon dimensions and orientation to provide freeboard sufficient to minimize, preferably eliminate, wave overtopping during sea transport of the apparatus. For example, in the catamaran pontoon arrangement shown in the first embodiment, one skilled in the art would select ratios of the pontoon length 24, pontoon width 27, and pontoon height 30 to provide effective hydrostatic stability of the apparatus on the surface of the water 12 during both transportation and installation. For the configuration such as that of the first embodiment, it is estimated that two pontoons, each 13 meters wide, 55 meters in length, and 10 meters high, would provide stable support for a drilling deck payload of 8,000 tons. One skilled in the art would be able to size pontoons 9 appropriately for larger or smaller payloads and determine proper spacing of the pontoons 9 to provide proper stability.

In both the first and second embodiments, the deck lifting capacity will be provided through the combined force provided by each of four lifting supports 6. The lifting supports 6 will expand enough to raise the deck 3 to provide vertical clearance 17 (FIGS. 2A and 5A) between the bottom 4 of the deck 3 and the upper end 16 of the substructure 15.

Preferably, this vertical clearance 17 between the bottom 4 of the deck 3 and the upper end 16 of the substructure 15 is at least 1 meter, more preferably 2 meters, even more preferably 3 meters.

The displacement of the lifting supports 6 can be provided by any mechanism capable of providing the desired lifting force. In both the first and second embodiments, each of the four lifting supports 6 comprises a jackhouse 10 and support leg 11 forming a rack-and-pinion gear driven jack assembly. Each of the jackhouses 10 is mounted on the deck 3. These jackhouses 10 are of the type commonly used in offshore jack-up drilling rigs and are well known to those skilled in the art. Each jackhouse 10 provides the connection between the deck 3 and a support leg 11 in these embodiments. The displacement of each the support leg 11 is provided by one or more tooth racks attached to at least one side the support leg 11. A pinion gear driven by a motor moves the jackhouse 10 along the length of the support leg 11. The support legs 11 should have adequate axial capacity and stability to lift the deck 3 into place and to resist the shear, moments, and other forces induced by gravity and environmental loads, including wind and waves. The construction of the support legs 11 may consist of truss lattices, tubular steel structures, or plate and stiffener construction. The cross-sectional shape of the support legs 11 may be triangular, rectangular, round, or any geometric shape designed to sufficiently withstand the required loads.

Figure 7A:
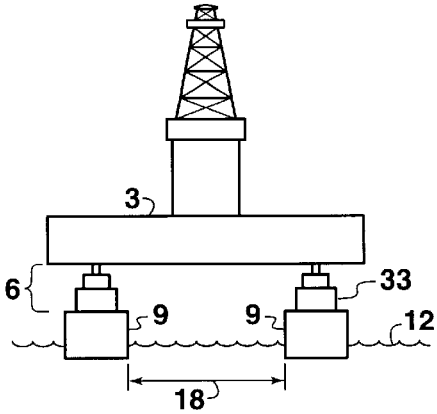
Figure 7B:
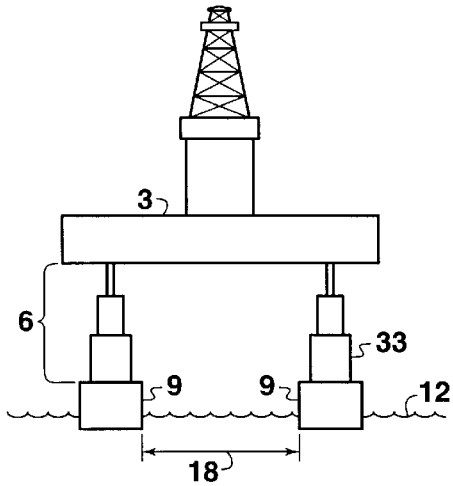
Figure 8A:
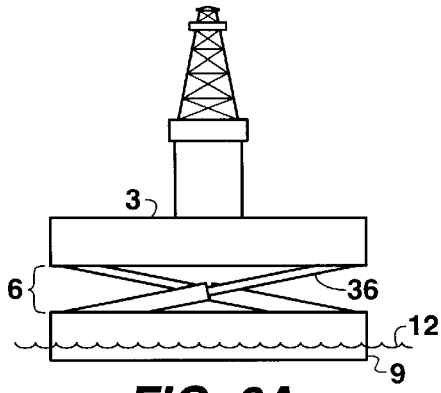
FIGS. 8A and 8B show front and side elevations of contracted and expanded hydraulic ram scissor lifting supports.
Figure 8B:
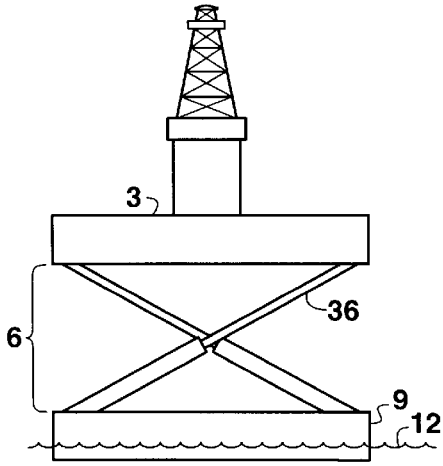
Figure 9A:
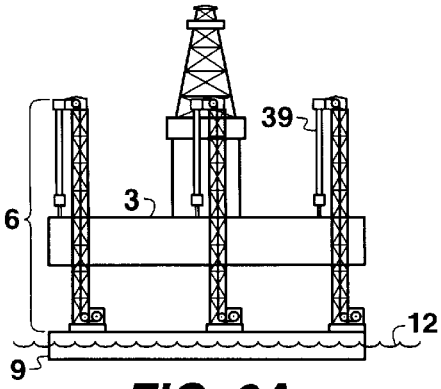
Figure 9B:
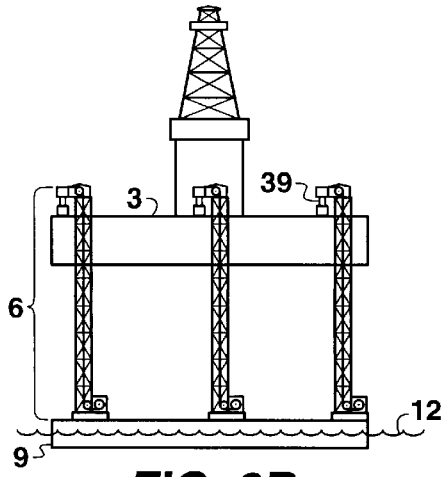

One skilled in the art would use standard engineering skills to select the number and placement of the lifting supports 6 and their attachment points on the pontoon(s) 9 and the deck 3. Other possible lifting supports 6 include but are not limited to: a system of two or more telescoping hydraulic rams 33 capable of raising and lowering the deck 3 as shown in FIGS. 7A and 7B; an expandable system of structural members 36 to raise and lower the deck 3 as shown in FIGS. 8A and 8B; or a system of cables or chains and pulleys 39 capable of raising and lowering the deck 3 as shown in FIGS. 9A and 9B. The lifting mechanism could be any combination or arrangement of mechanical members, hydraulic equipment, and/or electrical devices providing sufficient lifting force to support and elevate the deck 3 when the apparatus is floating and the pontoons 9 when the apparatus is mounted on an offshore substructure.

The deck 3 can contain any kind of equipment but will typically contain or support a drilling rig, drilling consumables, processing pumps and vessels, quarters for crew, a helicopter landing area, and all other equipment required to carry out exploration or production drilling. Decks of any size or weight could be designed by one skilled in the art. However, practical economic limits at this time suggest that typical deck weights would range from 4,000 tons to 20,000 tons. In a particularly preferred embodiment, the pontoon or pontoons provide additional deck working area in the operation configuration of the apparatus in addition to the floatation function during water transport of the apparatus. This dual service of the pontoons provides a reduction in the overall weight and cost.

In a preferred embodiment, the overall weight and cost of the apparatus is minimized by equalizing, to the greatest extent possible, the deck weight with the pontoon weight. For purposes of this calculation, the deck weight includes the weight of the integrated deck 3 and the weight of any portion of the lifting supports 6 rigidly attached to the deck 3. Similarly, pontoon weight includes the combined weight all the pontoons 9 and the weight of any portion of the lifting supports 6 rigidly attached to the pontoons 9. For example, in the first embodiment, the weight of the jackhouses 10 would be part of the deck weight and the weight of the legs 11 would be part of the pontoon weight.

For certain applications the pontoons may also be removed from the final deck installation to reduce the mass for particular design concerns such as seismic response. For other applications, due to specific transport concerns, the apparatus may also be configured to allow the deck to provide additional buoyancy in the floatation configuration. For instance, additional buoyancy provided by the deck during floatation will create additional free board and may add to the hydrodynamics stability of the apparatus during transport. However, the pontoons 6 must still provide sufficient buoyancy to support the entire weight of the apparatus during the installation process.

As described above, the present invention satisfies the need for low cost drilling systems capable of year-round mobile operation while still facilitating quick installation and removal from offshore substructures. The invention is especially suited for use in arctic environments and for use with the suction caisson substructure as disclosed in co-pending provisional patent application entitled "Offshore Caisson." This co-pending application, identified by applicants as docket No. 98.026 and filed by applicants hereunder on the same date as this provisional patent application, is fully incorporated herein by reference for purposes of U.S. patent practice.

The use of this invention is not limited to caisson substructures. It is equally well suited to single- or multi-column structures, space frame structures, structures of either concrete or steel construction, or structures supported on the ocean floor by gravity or by pile foundations. The apparatus may be used with any offshore substructure 15 having an upper end 16 suited for support of an integrated deck 3 and preferably elevated above the water surface 12. Such substructures are not only applicable to the arctic environment, but also to more temperate environments such as but not limited to the Gulf of Mexico, the North Sea, the Caspian Sea, and other similar areas.

It should be understood that the invention is not to be unduly limited to the foregoing which has been set forth for illustrative purposes. Various modifications and alterations of the invention will be apparent to those skilled in the art without departing from the true scope of the invention as defined in the following claims.

What is claimed is:

1. A self-floating apparatus for use in offshore oil and gas drilling and producing operations, said apparatus suited for being mounted on the upper end of an offshore substructure, said apparatus comprising:

a deck;

one or more pontoons having sufficient composite buoyancy to provide said apparatus with a net positive buoyancy; and at least one lifting support attached to each said pontoon, each said lifting support further attached to said deck and adapted to move said deck vertically relative to said pontoons.

2. The apparatus of claim 1 wherein said movement is between an extended position and a compressed position, said compressed position maintaining the deck sufficiently close to the water surface to provide stability for floating transportation of said apparatus, said extended position elevating the deck sufficiently to permit positioning said deck over said upper end of said offshore substructure.

3. The apparatus of claim 2 wherein said deck is suited for mounting on said upper end of said offshore substructure, when positioned over said upper end, by movement of said lifting supports from said extended position toward said compressed position until the weight of said apparatus is resting on said offshore substructure.

4. The apparatus of claim 3 wherein said pontoons can be lifted to a sufficient height above the water surface to eliminate exposure of the apparatus to loads induced by predetermined water conditions.

5. The apparatus of claim 3 wherein said pontoons are adapted to provide additional deck area when the apparatus is installed on the substructure and when said pontoons are lifted sufficiently out of the water.

6. The apparatus of claim 2 wherein said deck is adapted to provide additional buoyancy when the apparatus is floating and the lifting supports are in a compressed position.

7. The apparatus of claim 1 wherein said upper end of said substructure is located above the surface of the water.

8. The apparatus of claim 1 wherein said buoyancy is provided by two parallel pontoons, spaced apart a distance greater than the maximum width of said offshore substructure near the waterline.

9. The apparatus of claim 1 wherein said buoyancy is provided by a single U-shaped pontoon.

10. The apparatus of claim 1 wherein said buoyancy is provided by an open pattern of more than two pontoons.

11. The apparatus of claim 1 wherein each said lifting support is driven by a system selected from the group consisting of a rack-and-pinion gear driven jack, a telescoping hydraulic ram, an expandable system of structural members, and system of cables or chains and pulleys.

12. A method for installing a self-floating apparatus on the upper end of an offshore substructure, said upper end being adapted to support the weight of the apparatus, said method comprising the steps of:

transporting a deck supported by lifting supports mounted on one or more pontoons, haven sufficient buoyancy to provide said apparatus with a net positive buoyancy during installation, to a location proximate said substructure;

elevating said deck vertically relative to said pontoons with said lifting supports to an elevation sufficient to permit positioning of said deck over said upper end of said offshore substructure;

positioning said deck over said upper end of said offshore substructure; and retracting said lifting supports to lower said deck on to said upper end of said offshore substructure.

13. The method of claim 12 wherein said lifting supports are retracted an amount sufficient permit use of one or more pontoons as additional deck area.

* * * * *